US006163307A

United States Patent [19]

Kim et al.

[11] Patent Number: 6,163,307

[45] Date of Patent: Dec. 19, 2000

[54] MULTILAYERED HELICAL ANTENNA FOR MOBILE TELECOMMUNICATION UNITS

[75] Inventors: Jong Kyu Kim, Seongnam; In Shig Park, Yongin; Ho Seok Seo, Pyungtaek, all of Rep. of Korea

[73] Assignee: Korea Electronics Technology Institute, Kyunggi-Do, Rep. of Korea

[21] Appl. No.: 09/401,468

[22] Filed: Sep. 22, 1999

[30] Foreign Application Priority Data

Dec. 1, 1998 [KR] Rep. of Korea ..... 98-52315

[51] Int. Cl.[7] ..... H01Q 1/36

[52] U.S. Cl. ..... 343/895; 343/702; 343/774

[58] Field of Search ..... 315/895, 702, 315/900, 901, 774

[56] References Cited

U.S. PATENT DOCUMENTS

| | | | |
|---|---|---|---|
| 5,798,737 | 5/2000 | Kanaba et al. | 343/895 |
| 5,861,852 | 1/1999 | Asakura et al. | 343/702 |
| 5,933,116 | 8/1999 | Suesada et al. | 343/702 |
| 5,977,927 | 11/1999 | Mandai et al. | 343/788 |
| 6,028,568 | 2/2000 | Asakuru et al. | 343/895 |
| 6,031,496 | 2/2000 | Kuittinen et al. | 343/702 |
| 6,069,592 | 5/2000 | Kanaba et al. | 343/895 |

*Primary Examiner*—Tan Ho
*Assistant Examiner*—Tuyet T. Vo
*Attorney, Agent, or Firm*—Roseman & Colin LLP

[57] ABSTRACT

A multilayered helical antenna for mobile communication units includes a first dielectric sheet, a plurality of second dielectric sheets, a plurality of second and third dielectric sheets. All of the second dielectric sheets, except one, have a starting hole and an ending hole, with the exception having the starting hole only. Each of the second dielectric sheet is provided with a partially opened circular metallic pattern. Each of the third dielectric sheets has a via hole. Each of the dielectric sheets has a through-hole at a center thereof in order to allow a whip antenna to be slid upward and downward along a center axis of a helical antenna which is formed by stacking the dielectric sheets in a predetermined order. The via holes are filled with the same conducting material as the partially opened circular metallic patterns to thereby vertically connect the partially opened circular metallic patterns on the second dielectric sheets through the corresponding starting holes and ending holes, thereby forming a spiral capable of transmitting and receiving horizontal and vertical polarizations.

13 Claims, 5 Drawing Sheets

MULTILAYERED HELICAL ANTENNA FOR MOBILE TELECOMMUNICATION UNITS

FIELD OF THE INVENTION

The present invention relates to an antenna for transmitting and receiving radio frequency signals; and, more particularly, to a multilayered helical antenna for use in mobile telecommunication units, the antenna incorporating therein a plurality of dielectric sheets, wherein the dielectric sheets some of which are each provided with a conductor pattern are stacked on top of each other.

DESCRIPTION OF THE PRIOR ART

As is well known, a helical antenna is provided with a dielectric body and an elongated metallic conductor having an appropriate length and spirally or helically wound therearound.

There is shown in FIGS. 1A and 1B a typical helical antenna. As shown, the helical antenna includes a dielectric body 30 having a through-hole 40 at center thereof, and a metallic coil 10 or a metallic conductor pattern 20 spirally or helically wound on the dielectric body 30, whereby a power is fed through a coaxial line thereof. Further, the helical antenna includes a monopole antenna 50 extendibly and receivably inserted into the through-hole 40 to thereby allow it to be used as a retractable antenna.

Generally, in such an antenna, if the length of one turn of the spiral conductor loop constituting the helical antenna is similar to the wavelength used, then a main beam is axially established along the spiral direction. However, if the length of one turn is far shorter than the wavelength used, then the main beam is established perpendicular to an axis of the antenna. Such a antenna is known as a normal-mode helical antenna("NMHA"). In the NMHA, a current path corresponds to a total length of the conductor. As a result of the conductor is being spirally wound around the dielectric body, the current path thereof is extremely large in comparison to a vertical length of the antenna, i.e., usually a multiple of ten times the vertical length, allowing the helical antenna to exhibit excellent radiation resistance characteristics. The radiation resistance increases, upto a limit, in proportion to a square of the length of the conductor path increased, the limit being one wavelength. However, when the length increases beyond the limit, the radiation resistance decreases. In other words, a winding number and a turn radius of the spiral conductor in the helical antenna cannot be indefinitely increased and they must be appropriately balanced in order to provide the optimum performance.

Recent trend in designing of mobile telecommunication units is toward miniaturization and consequently the antenna used therein must be made smaller. However, as a result of the above stated limitations, there is a limit in the degree of miniaturization that can be possible with the currently available helical antennas.

SUMMARY OF THE INVENTION

It is, therefore, a primary object of the invention to provide an antenna for mobile telecommunication units, having a reduced size.

In accordance with one aspect of the present invention, there is provided a multilayered helical antenna for use in mobile telecommunication units comprising a first dielectric sheet provided with a through-hole at a center thereof; a plurality of second dielectric sheets, all of the second dielectric sheets, except one, being provided with a starting hole and an ending hole, the exception having second dielectric sheet having only one starting hole, each being provided with a partially opened circular metallic pattern and a through-hole at a center thereof, wherein the partially opened circular metallic pattern extends from the starting hole to the ending hole in the respective second dielectric sheet except for the dielectric sheet having the starting hole only where the partially opened circular metallic pattern extends from the starting hole to a free end; and a plurality of third dielectric sheets, each being provided with via hole and a through-hole at a center thereof, wherein the dielectric sheets are stacked in a predetermined order, the order being that the first dielectric sheet is placed at top of the stack followed by the second dielectric sheet with the starting hole only followed by the third dielectric sheet followed by the second dielectric sheet followed by the third dielectric sheet and so on, with the third dielectric sheet being placed at bottom of the stack, the via holes being filled with a conducting material to thereby vertically connect the partially opened circular metallic patterns on the second dielectric sheets through the corresponding starting holes and ending holes, forming a spiral inside the stack of dielectric sheets, thereby forming a helical antenna, and the through-holes therein being used to allow a whip antenna to be slid upward and downward along a center axis of the helical antenna to thereby form said multilayered helical antenna.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1A:
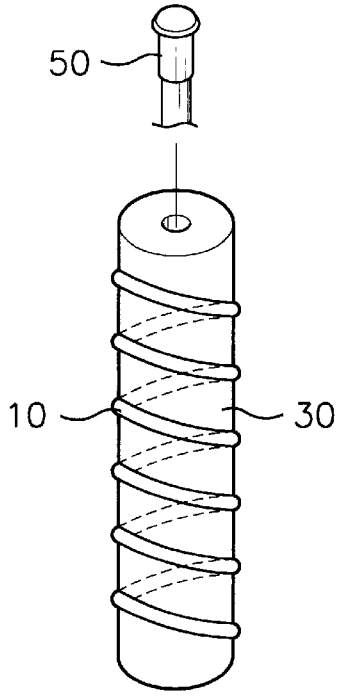
FIG. 1A (PRIOR ART)
FIGS. 1A and 1B represent a fragmentary exploded view of a conventional helical antenna.
Figure 1B:
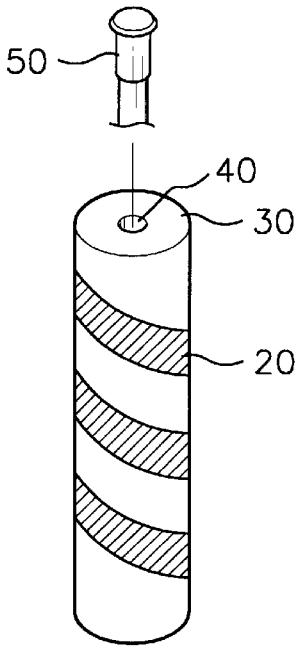
FIG. 1B (PRIOR ART)
Figure 2:
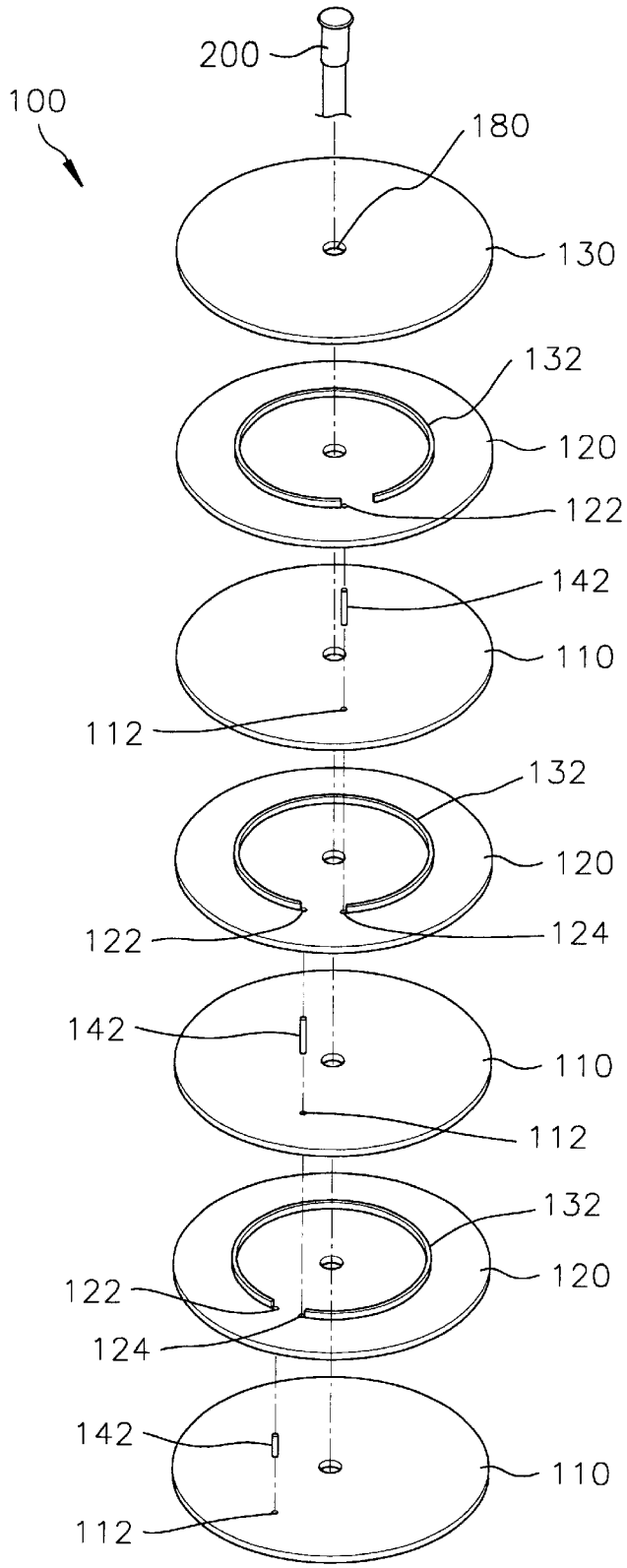
FIG. 2 sets forth an exploded perspective view of a structure of a multilayered antenna in accordance with a preferred embodiment of the present invention.

There is shown in FIG. 2 a detailed structure of a multilayered helical antenna in accordance with a preferred embodiment of the present invention. As shown, the inventive multilayered helical antenna 100 includes a first dielectric sheet 130, a plurality of second dielectric sheets 120 and a plurality of third dielectric sheets 110. Each of the dielectric sheets 110 to 130 has a substantially disc shape and is made of a dielectric material having a predetermined dielectric constant and is provided with a through-hole 180 at a center thereof, allowing a whip antenna 200 to be slid upward and downward along a center axis of the helical antenna 100 which is formed by stacking the dielectric sheets in a predetermined order, the order being that the first dielectric sheet 130 is placed at top of the stack followed by the second dielectric sheet 120 followed by the third dielectric sheet 110 followed by the second dielectric sheet 120 followed by the third dielectric sheet 110 and so on, with the third dielectric sheet 110 being placed at bottom of the stack.

It is of course that each of the dielectric sheets 120 and 130 may be formed in a predetermined thickness or each thereof may be formed by a plurality of dielectric sheets to obtain the predetermined thickness.

All of the second dielectric sheets 120, except one, are each provided with a starting hole 122 and an ending hole 124, with an exception having only one starting hole 122. The second dielectric sheet with the one starting hole 122 only is always placed right below the first dielectric sheet 130. It may be that the starting holes 122 and the ending holes 124 have a diameter of about 0.4 mm.

Each of the third dielectric sheets 110, on the other hand, is provided with a via hole 112.

Figure 3A:
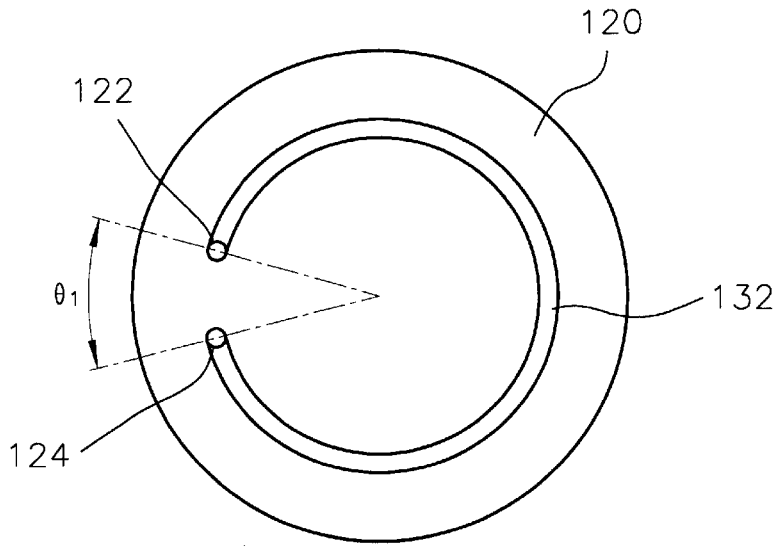
FIGS. 3A to 3C present plan views of a multilayered antenna for illustrating a helical conductor pattern.
Figure 3B:
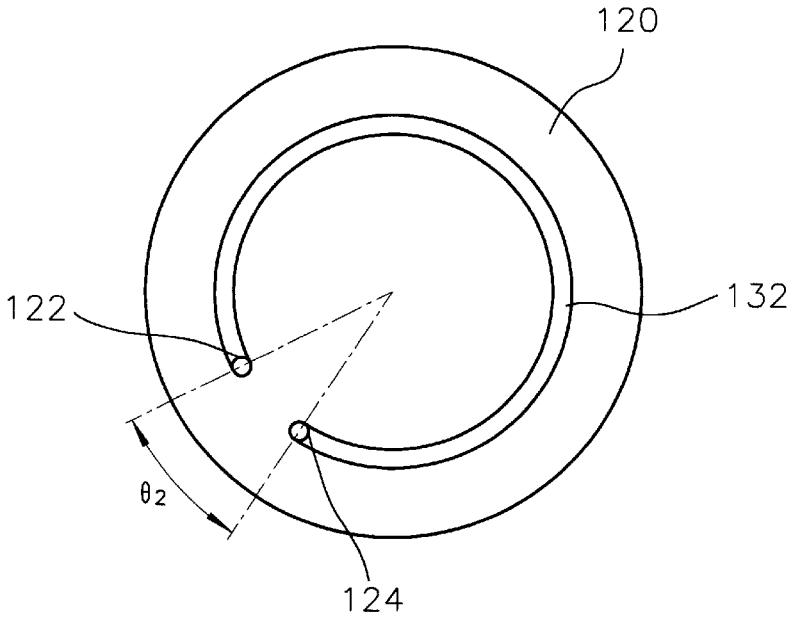
Figure 3C:
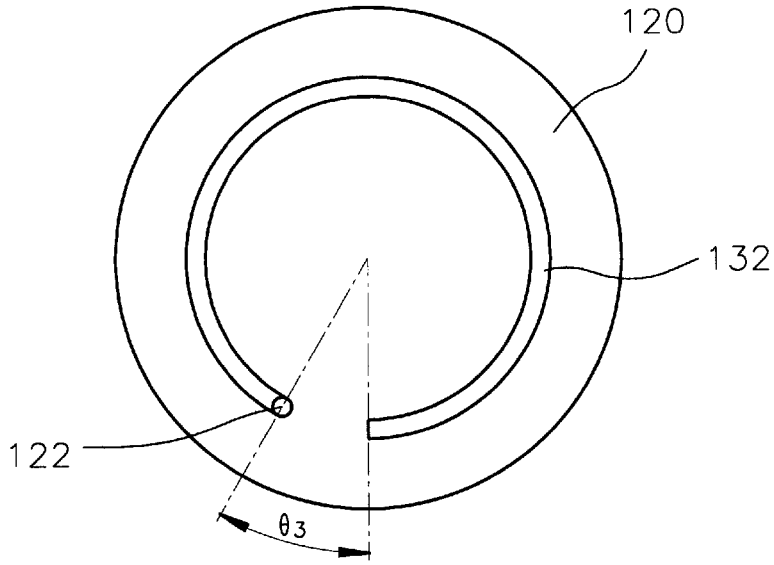

Further, each of the second dielectric sheets 120 is provided with a partially opened circular metallic pattern 132, made of a conducting material, e.g., silver (Ag) or copper (Cu), formed in the same rotating direction. The partially opened circular metallic pattern 132 of the second dielectric sheets 120 positioned right above the third dielectric sheet 110 located at bottom of the stack extends from the starting holes 122 to the ending hole 124 with an arc angle θ1 between the holes 122 and 124 as shown in FIG. 3A. The partially opened circular metallic pattern 132 of the successive second dielectric sheet 110 is formed in the same manner as the partially opened circular metallic pattern 132 of the previous second dielectric sheet 120 with an arc angle θ2 between the holes 122 and 124 as shown in FIG. 3B. The circular metallic pattern 132 of the second dielectric sheet 120 located right below the first dielectric sheet 130 extends from the starting hole 122 to a free end thereof with an arc angle θ3 between the starting hole 122 and the free end thereof as shown in FIG. 3C. It is preferable that the arc angles of θ3 is substantially equal or smaller than that of θ1 and θ2 and θ1 and θ2 are equal to each other. In a preferred embodiment, a pattern thickness, an inner diameter, an outer diameter and a pattern width of each the partially opened circular metallic patterns 132 may be changed depending on a frequency band used and are, in case of a personal communication system(PCS) utilizing the frequency band of 1.8 GHz, are approximately 0.4 mm, 4.5 to 5 mm, 5 to 5.5 mm and approximately 0.4 to 0.45 mm, respectively.

Further, the via hole 112 of the third dielectric sheet 110 located at bottom of the stack corresponds to the starting hole 122 of the second dielectric sheet 120 located thereabove, that of the second dielectric sheet 120 located above the second dielectric sheet located above the third dielectric sheet 110 at bottom of the stack corresponds to the starting hole 122 of the second dielectric sheet 120 and the closing hole 124 of the third dielectric sheet 110 located below the first dielectric sheet 130, and that of the third dielectric sheet 110 corresponds to the starting hole 122 of the second dielectric sheet 120 located below the first dielectric sheet 130 and the starting hole 124 of the second dielectric sheet 120 located therebelow.

The via holes 112 are filled with the same conducting material 142 as the partially opened circular metallic patterns to thereby vertically connect the partially opened circular metallic patterns 132 on the second dielectric sheets 120 through the corresponding starting holes 122 and ending holes 124.

Figure 4:
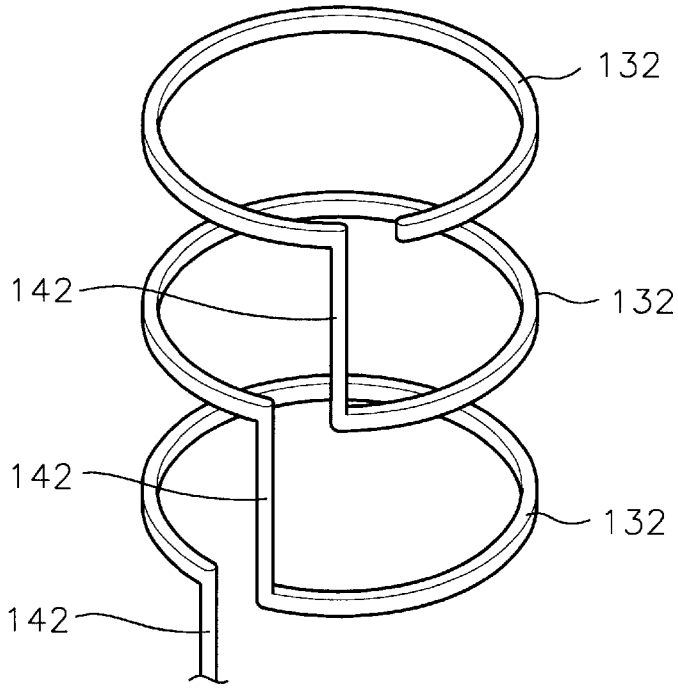
FIG. 4 illustrates a perspective view of a spiral conductor of the multilayered helical antenna shown in FIG. 2.

When the partially opened circular patterns 132 are vertically connected through the conducting material 142 in the via holes 112 and the starting and the ending holes 122 and 124, a spiral is formed as shown in FIG. 4, allowing it to transmit and receive horizontal and vertical polarizations. That is, the partially opened circular metallic patterns 132 maintain circles in the horizontal direction to thereby form a conventional helical antenna structure, while the conducting materials 142 in the via holes 112 form a conventional monopole antenna structure in the vertical direction, thereby providing the inventive antenna with an omnidirectional antenna characteristic capable of transmitting and receiving the horizontal and vertical polarizations.

In the inventive helical antenna, it is preferable that the total length of the spiral shown in FIG. 4 is λ/4 at a desired operating center frequency and may be selectively controlled depending on the dielectric constant of the dielectric sheet.

Further, it is preferable that for use at 1.8 GHz, the helical antenna may be constructed using the spiral having 2.5 turns, i.e., two and a half partially opened circular metallic patterns, and for use at 1.2 GHz, 4 turns. Further, it is preferable that each of the partially opened circular metallic patterns 132 are as close to a circle of 360° as possible in order to transmit and receive horizontal polarizations, but usually include the opening of 5 to 15°.

Figure 5:
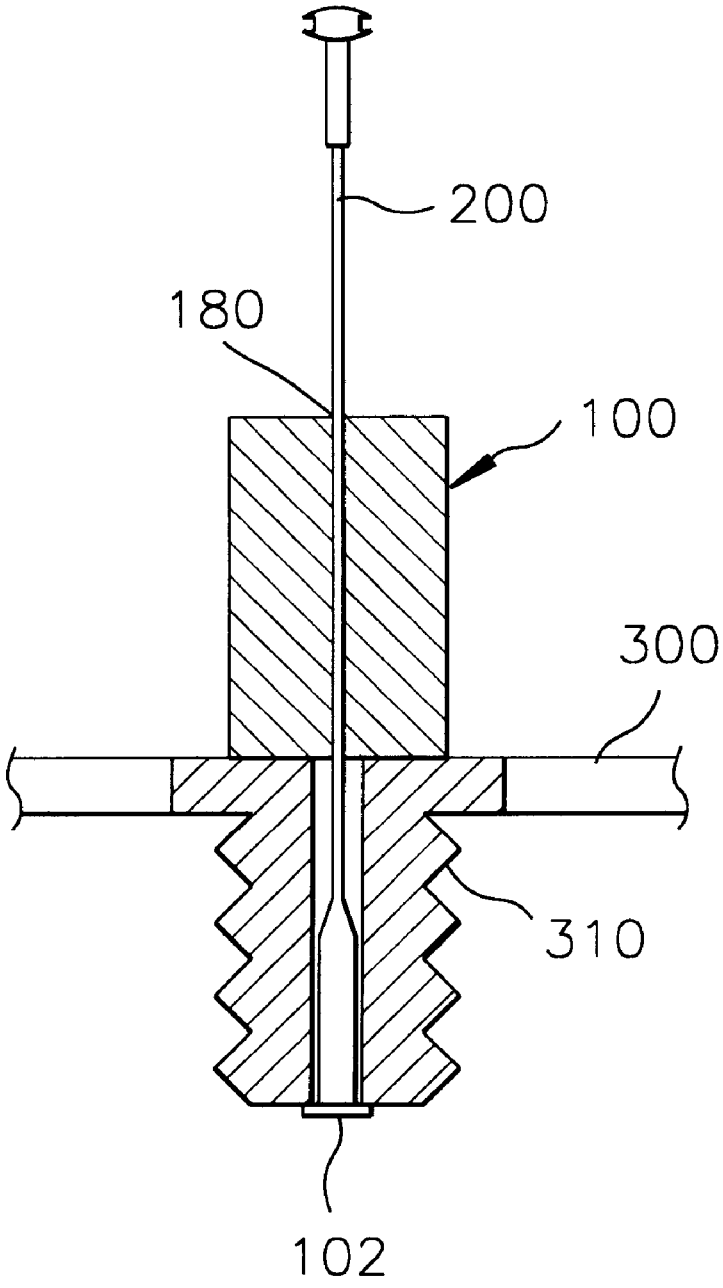
FIG. 5 depicts a partial cross sectional view of an inventive multilayered antenna mounted on a radio mobile station.

These dielectric sheets 110 to 130 as described above are integrated through a stacking process at a high temperature and a high pressure to form the helical antenna 100 as illustrated in FIG. 5. A height of the helical antenna 100 may be changed depending on the frequency being used, the length of the partially opened circular metallic patterns 132 and the depth of the via holes 112, i.e., thickness of the dielectric sheets, since a vertical element of the helical antenna 100 is formed by the conducting material 142 filling the via holes 112. For example, the height thereof for use as a mobile telecommunication antenna is approximately 5 to 15 mm.

In FIG. 5, the inventive multilayered antenna includes a helical antenna 100 with a through-hole 180 at a center thereof and mounted on a coaxial feeder 310 of a unit body 300 and a whip antenna 200, which is a metallic monopole antenna, disposed movably along the center axis, i.e., of the helical antenna 100. It should be noted that the helical antenna used herein has the structure described hereinabove. A diameter of the through-hole 180 can be varied depending on that of the whip antenna 200, and, in general, is 2.5 to 3 mm. Further, a length of the whip antenna 200 is basically a multiple of λ/8, but it may be selectively varied.

When the whip antenna 200 extends out from the unit 300 through the center of the helical antenna 100, a feeding terminal 102 formed on a lower portion of the whip antenna 200 comes in contact with the coaxial feeder 310 of the unit 300. As a result, a voltage is applied through the feeding terminal 120 from a matching circuit (not shown) to the whip antenna 200 in such a way that a power is fed to the whip antenna 200. Further, since the helical antenna 100 is fixed to the coaxial feeder 310, the power is fed to helical antenna 100 regardless of whether the power is fed to the whip antenna 200 or not.

On the other hand, when the whip antenna 200 is pushed inside the unit 300 through the center of the helical antenna 100, the feeding terminal 102 formed on a lower portion of the whip antenna 200 is electrically disconnected from the coaxial feeder 310 of the unit 300. As a result, a voltage cannot be applied to the whip antenna 200 and consequently the whip antenna 200 becomes inoperational and the helical antenna 100 only operates to transmit and receive a signal.

As described above, the helical antenna of the present invention can transmit and receive the horizontal and the vertical polarizations by itself. Further, since the spiral patterns are formed directly on the dielectric sheets, it is possible that the manufacturing processes becomes simpler.

While the invention has been shown and described with respect to the preferred embodiments, it will be understood by those skilled in the art that various changes and modifications may be made without departing from the spirit and scope of the invention as defined in the following claims.

What is claimed is:

1. A multilayered helical antenna for use in mobile communication units comprising:

a first dielectric sheet provided with a through-hole at a center thereof;

a plurality of second dielectric sheets, all of the second dielectric sheets, except one, being provided with a starting hole and an ending hole, the exception is the first one of second dielectric sheets having only one starting hole, each being provided with a partially opened circular metallic pattern and a through-hole at a center thereof, wherein the partially opened circular metallic pattern extends from the starting hole to the ending hole in the respective second dielectric sheet except for the dielectric sheet having the starting hole only where the partially opened circular metallic pattern extends from the starting hole to a free end; and a plurality of third dielectric sheets, each being provided with a via hole and a through-hole at a center thereof, wherein the dielectric sheets are stacked in a predetermined order, the order being that the first dielectric sheet is placed at top of the stack followed by the second dielectric sheet with the starting hole only followed by the third dielectric sheet followed by the second dielectric sheet followed by the third dielectric sheet and so on, with the third dielectric sheet being placed at bottom of the stack, the via holes being filled with a conducting material to thereby vertically connect the partially opened circular metallic patterns on the second dielectric sheets through the corresponding starting holes and ending holes, forming a spiral inside the stack of dielectric sheets, thereby forming a helical antenna, and the through-holes therein being used to allow a whip antenna to be slid upward and downward along a center axis of the helical antenna to thereby form said multilayered helical antenna.

2. The multilayered helical antenna of claim 1, wherein each of the dielectric sheets has a substantially disc shape and is made of a dielectric material having a predetermined dielectric constant.

3. The multilayered helical antenna of claim 1, wherein each of the dielectric sheets is formed in a predetermined thickness or each thereof is formed by a plurality of dielectric sheets to obtain the predetermined thickness.

4. The multilayered helical antenna of claim 1, wherein each of the starting hole and the ending hole have a diameter of about 0.4 mm.

5. The multilayered helical antenna of claim 1, wherein the partially opened circular metallic patterns are formed in the same rotating direction.

6. The multilayered helical antenna of claim 1, wherein the arc angle between the starting hole and the free end is substantially equal or smaller than that between the starting hole and the ending hole being equal to each other.

7. The multilayered helical antenna of claim 1, wherein a pattern thickness, an inner diameter, an outer diameter and a pattern width of each the partially opened circular metallic patterns are changed depending on a frequency band used and, in case of a personal communication system utilizing the frequency band of 1.8 GHz, are approximately 0.4 mm, 4.5 to 5 mm, 5 to 5.5 mm and approximately 0.4 to 0.45 mm, respectively.

8. The multilayered helical antenna of claim 1, wherein the partially opened circular metallic patterns maintain circles in the horizontal direction to thereby form a conventional helical antenna structure, while the conducting materials in the via holes form a conventional monopole antenna structure in the vertical direction, thereby providing the multilayered antenna with an omnidirectional antenna characteristic capable of transmitting and receiving horizontal and vertical polarizations.

9. The multilayered helical antenna of claim 1, wherein the total length of the spiral is $\lambda/4$ at a desired operating center frequency, wherein $\lambda$ is a wavelength of a radio frequency signal.

10. The multilayered helical antenna of claim 1, wherein the partially opened circular metallic patterns are made of a conducting material.

11. The multilayered helical antenna of claim 1, wherein the spiral has two and a half turns of the partially opened circular patterns for use at 1.8 GHz and four turns of the partially opened circular patterns for use at 1.2 GHz.

12. The multilayered helical antenna of claim 1, wherein each of the partially opened circular metallic patterns is as close to a substantially circle of 360° in order to transmit and receive horizontal polarizations.

13. The multilayered helical antenna of claim 1, wherein each of the partially opened circular metallic patterns has an opening of 5 to 15°.

* * * * *